US011033772B2

(12) United States Patent
Saab et al.

(10) Patent No.: US 11,033,772 B2
(45) Date of Patent: Jun. 15, 2021

(54) WEIGHTED WEARABLE TRAINING APPARATUS

(71) Applicant: ROKET GEAR INC., Edmonton (CA)

(72) Inventors: Nizar Saab, Edmonton (CA); Edward Halabi, Edmonton (CA)

(73) Assignee: ROCKET GEAR INC., Edmonton (CA)

( * ) Notice: Subject to any disclaimer, the term of this patent is extended or adjusted under 35 U.S.C. 154(b) by 0 days.

(21) Appl. No.: 16/451,678

(22) Filed: Jun. 25, 2019

(65) Prior Publication Data

US 2020/0368573 A1 Nov. 26, 2020

(30) Foreign Application Priority Data

May 24, 2019 (CA) ..... 3044456

(51) Int. Cl.
*A63B 21/00* (2006.01)
*A63B 21/06* (2006.01)
*A63B 21/065* (2006.01)

(52) U.S. Cl.
CPC ..... *A63B 21/4011* (2015.10); *A63B 21/0601* (2013.01); *A63B 21/065* (2013.01)

(58) Field of Classification Search
CPC ..... A63B 21/4011; A63B 21/0601; A63B 21/065; A63B 21/4035; A63B 24/04; A63B 21/1636; A63B 23/00; A63B 21/068; A63B 71/02; A63B 23/12; A63B 21/0552; A63B 21/0557; A63B 21/00069; A41D 1/05
See application file for complete search history.

(56) References Cited

U.S. PATENT DOCUMENTS

| | | | | |
|---|---|---|---|---|
| 2,241,833 A | | 5/1941 | Waller | |
| 2,952,459 A | | 9/1960 | Moffitt | |
| 3,278,184 A | | 10/1966 | Rosenbaum | |
| 3,306,610 A | | 2/1967 | Biggs, Jr. et al. | |
| 3,366,380 A | | 1/1968 | Montour | |
| 3,427,020 A | | 2/1969 | Montour et al. | |
| 3,759,510 A | | 9/1973 | Jackson, Jr. | |
| 4,180,261 A | * | 12/1979 | Kolka | A63B 21/065 2/22 |
| 4,632,389 A | | 12/1986 | Moss | |
| 4,684,123 A | * | 8/1987 | Fabry | A63B 21/065 482/105 |
| 4,838,546 A | | 6/1989 | Winston | |
| 4,966,365 A | | 10/1990 | Winston | |
| 4,997,183 A | | 3/1991 | Winston | |

(Continued)

FOREIGN PATENT DOCUMENTS

| | | | | |
|---|---|---|---|---|
| GB | 2317838 A | | 8/1998 | |
| WO | WO 2006/124133 | * | 11/2006 | A63B 21/065 |

*Primary Examiner* — Nyca T Nguyen
*Assistant Examiner* — Andrew M Kobylarz
(74) *Attorney, Agent, or Firm* — Finch & Maloney, PLLC; Michael J. Bujold

(57) ABSTRACT

A weighted wearable training apparatus has a weight shell with a front surface, a rear surface, a top, a bottom, a first side edge and a second side edge. The weight shell is adapted to cover at least a portion of a user's limb. A plurality of pockets are positioned on the rear surface of the weight shell. At least one removable weight sized to fit within one of the pockets. At least one attachment mechanism is provided for holding the weight shell to the user's limb.

17 Claims, 8 Drawing Sheets

(56) References Cited

U.S. PATENT DOCUMENTS

| | | | | |
|---|---|---|---|---|
| 5,162,032 | A | 11/1992 | Dohner | |
| 5,514,056 | A * | 5/1996 | Ronca | A63B 21/0607 482/105 |
| 7,090,624 | B1 | 8/2006 | Chrishon | |
| 7,354,385 | B2 * | 4/2008 | Virji | A63B 21/065 482/105 |
| 8,443,465 | B2 * | 5/2013 | Stewart | A63B 21/0601 2/94 |
| 9,604,091 | B2 | 3/2017 | Haley | |
| 2002/0010058 | A1 | 1/2002 | Myrick | |
| 2006/0135326 | A1 * | 6/2006 | Virji | A63B 21/4011 482/105 |
| 2006/0172870 | A1 | 8/2006 | Virji | |
| 2008/0280737 | A1 * | 11/2008 | Cook | A63B 21/065 482/105 |
| 2009/0253560 | A1 * | 10/2009 | Cook | A63B 21/4007 482/105 |
| 2010/0311551 | A1 * | 12/2010 | Winston | A63B 21/0605 482/105 |
| 2012/0255097 | A1 | 10/2012 | Feuchs | |
| 2013/0017933 | A1 * | 1/2013 | Foster | A41D 31/185 482/105 |

* cited by examiner

WEIGHTED WEARABLE TRAINING APPARATUS

FIELD OF THE DISCLOSURE

The present application relates generally to a weighted wearable training apparatus, more particular it relates to a weighted apparatus for use on a limb for training, exercise and rehabilitation.

BACKGROUND

This section provides background information to facilitate a better understanding of the various aspects of the invention. It should be understood that the statements in this section of this document are to be read in this light, and not as admissions of prior art.

Adding weight to a limb during exercise can have beneficial effects for an athlete during training or for individuals looking to rehabilitate after an injury. However, the positioning of added weight can affect the user's gaits and movements which can cause stress to muscles, tendons, ligaments and bones. Strategically placing weights on a user's limb may limit or eliminate changes to the user's movement, allowing for proper weight training and potential improvements to the user's speed, stamina and strength.

BRIEF SUMMARY

There is provided a weighted wearable training apparatus that has a weight shell with a front surface, a rear surface, a top, a bottom, a first side edge and a second side edge. The weight shell is adapted to cover at least a portion of a user's limb. The weight shell has a plurality of pockets on the rear surface. At least one removable weight is sized to fit within one of the pockets. At least one attachment mechanism is provided for holding the weight shell to the user's limb.

In one embodiment, the weight shell has at least two tiers of pockets.

In one embodiment, the weight shell has three tiers of pockets.

In one embodiment, the number of attachment mechanisms for holding the weight shell to the user's limb is equal to the number of tiers of pockets.

In one embodiment, the weight shell is shaped such that each consecutive tier of pockets has a width less than the tier of pockets above.

In one embodiment, the weight shell is shaped such that a first tier of pockets is positioned above a second tier of pockets and a third tier of pockets is positioned below the second tier of pockets. The first tier of pockets has a width greater than the second tier of pockets and the second tier of pockets has a width greater than the third tier of pockets.

In one embodiment, the at least one attachment mechanism is adjustable. The attachment mechanism may be a strap or any other suitable means known to a person skilled in the art.

In one embodiment, a female buckle connector is attached to the weight shell and a male buckle connector is attached to the at least one strap. The male buckle is sized to connect with the female buckle connector.

In one embodiment, the at least one removable weight is cylindrical in shape. The weight may be made of stainless steel or any other suitable material known to a person skilled in the art. Each weight may weigh between 0.25 to 0.5 pounds.

In one embodiment, the weight shell is adapted to fit around a shin pad.

In one embodiment, the at least one strap has a hood and loop fastener such as Velcro™ to hold excess strap to prevent the excess strap from moving around.

In one embodiment, the front surface of the weight shell is nylon.

In one embodiment, the rear surface of the weight shell is neoprene.

In one embodiment, the plurality of pockets are substantially uniform in size.

BRIEF DESCRIPTION OF THE DRAWINGS

These and other features will become more apparent from the following description in which references are made to the following drawings, in which numerical references denote like parts. The drawings are for the purpose of illustration only and are not intended to in any way limit the scope of the invention to the particular embodiments shown.

DETAILED DESCRIPTION OF THE PREFERRED EMBODIMENTS

Figure 1:
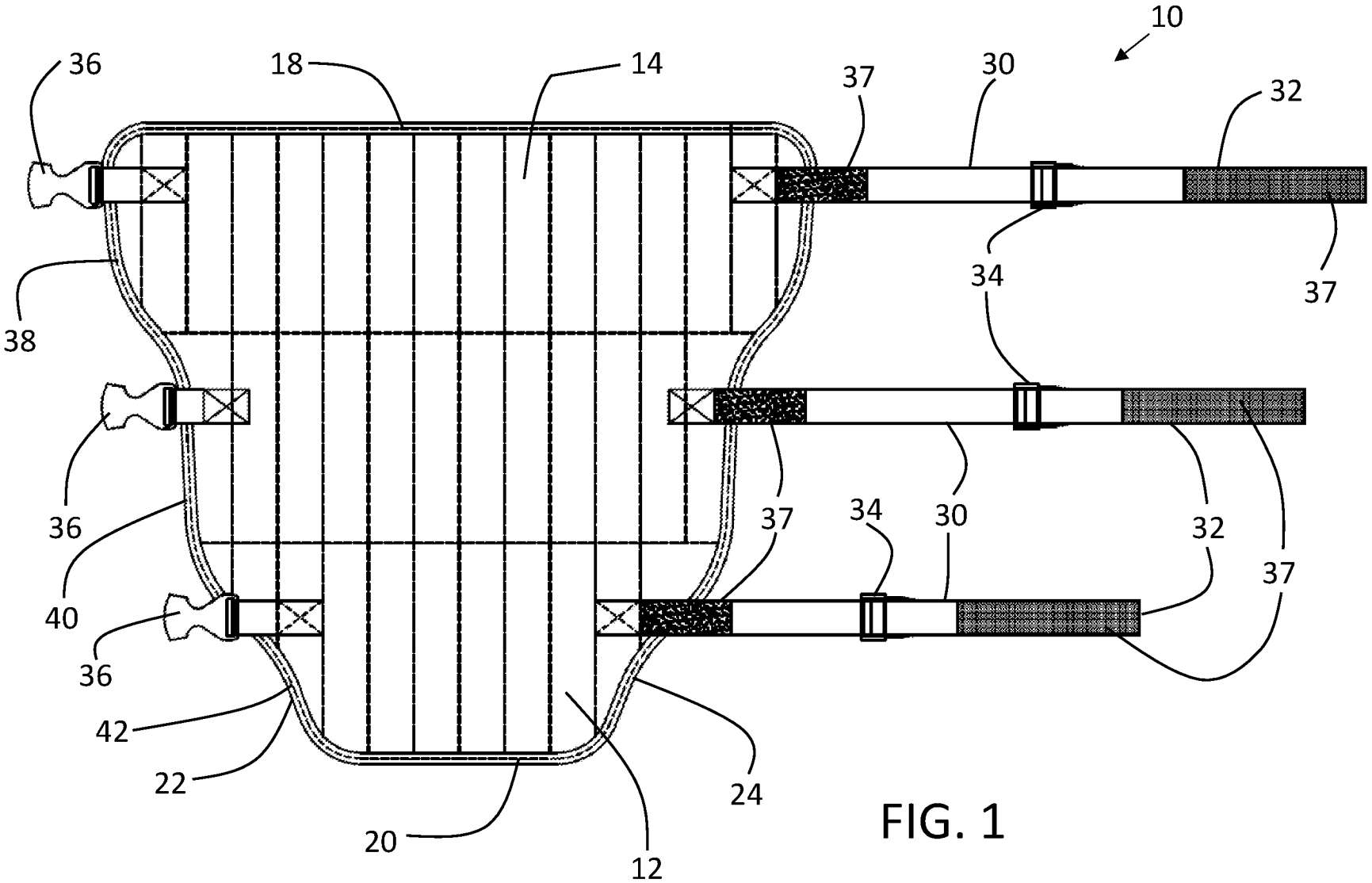
FIG. 1 is a front elevation view of a weighted wearable training apparatus.

A weighted wearable training apparatus, generally identified by reference numeral 10, will now be described with reference to FIG. 1 through FIG. 12.

Figure 2:
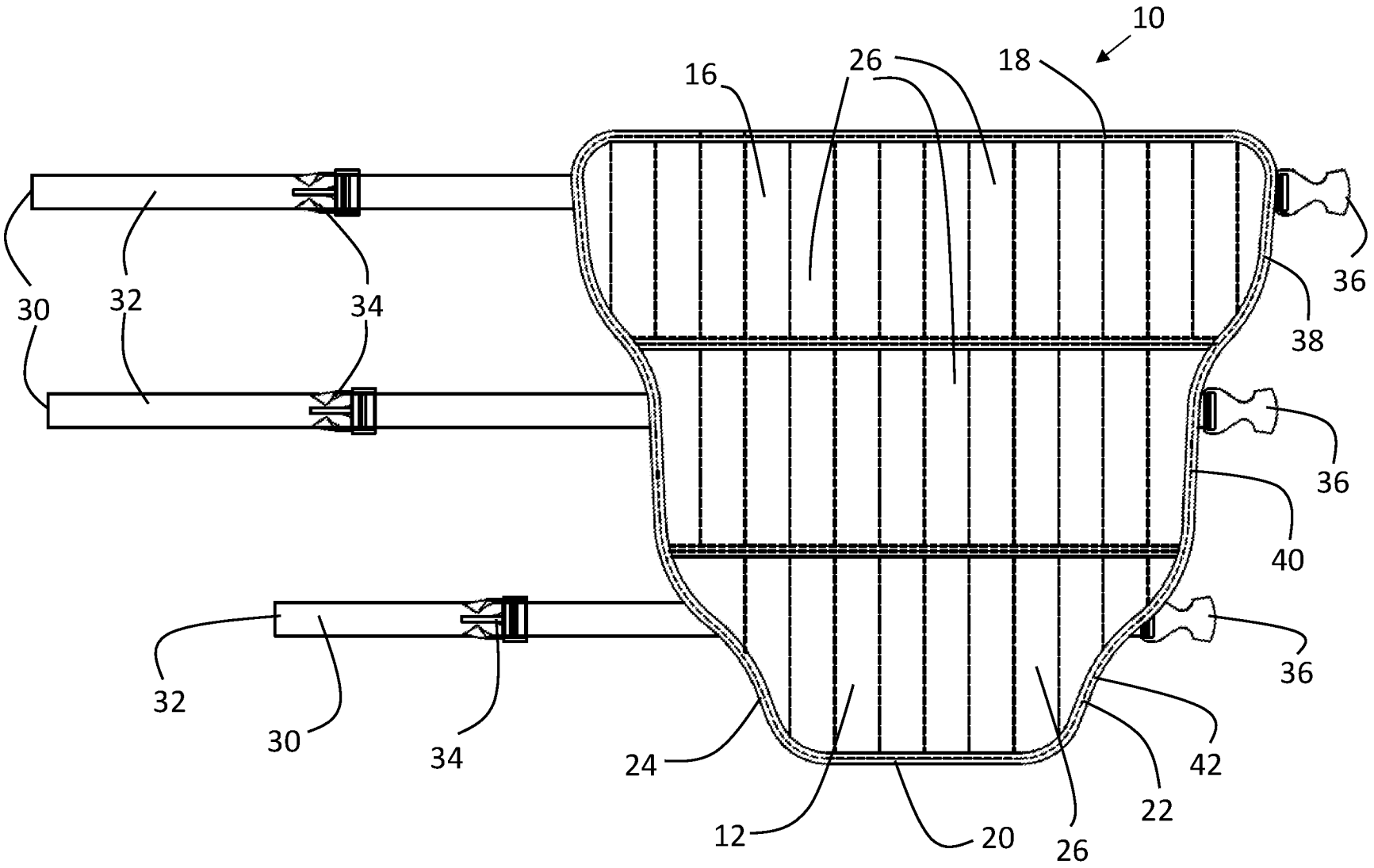
FIG. 2 is a rear elevation view of the weighted wearable training apparatus shown in FIG. 1.
Figure 3:
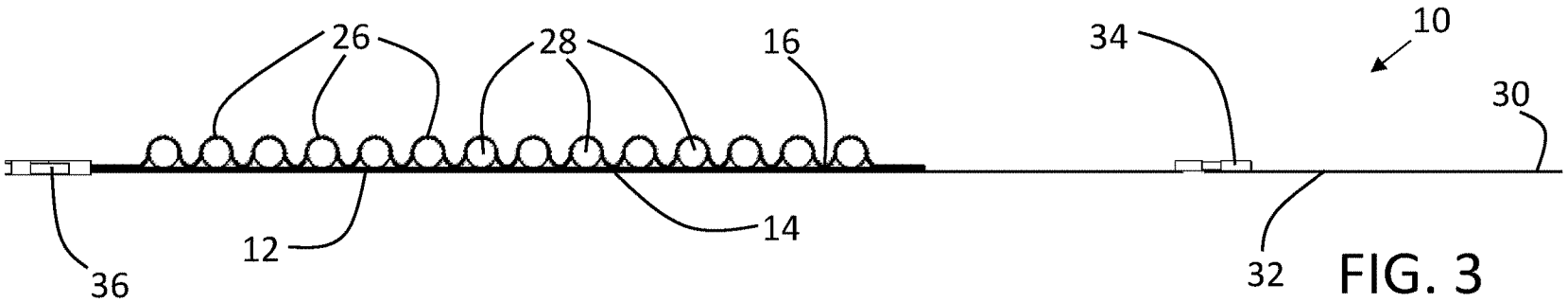
FIG. 3 is a top plan view of the weighted wearable training apparatus shown in FIG. 1.
Figure 10:
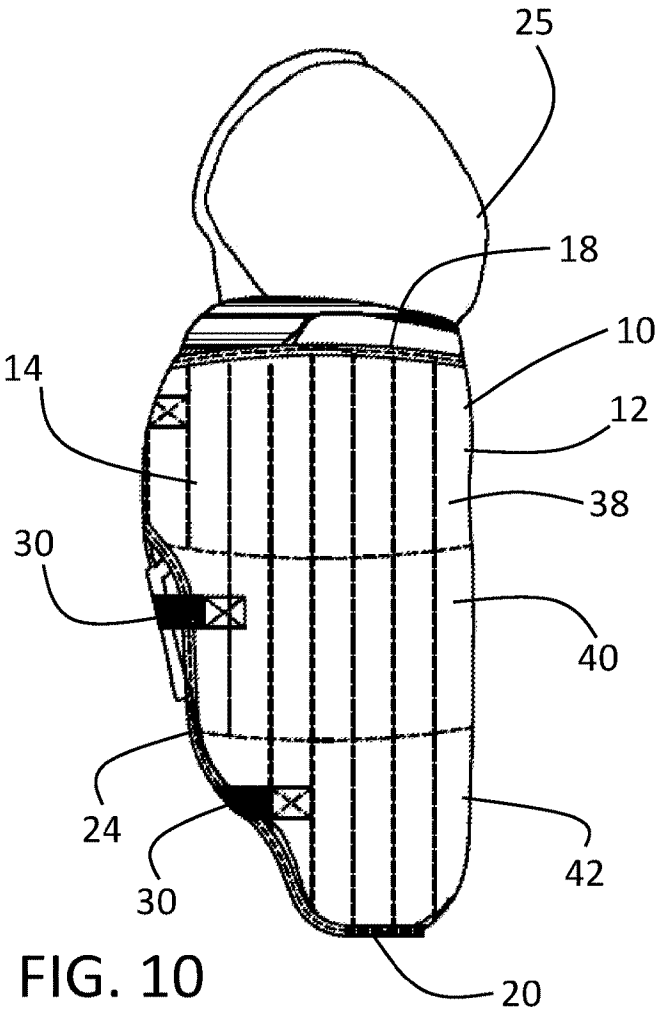
FIG. 10 is a side elevation view of the weighted wearable training apparatus shown in FIG. 1 on a hockey shin pad.
Figure 9:
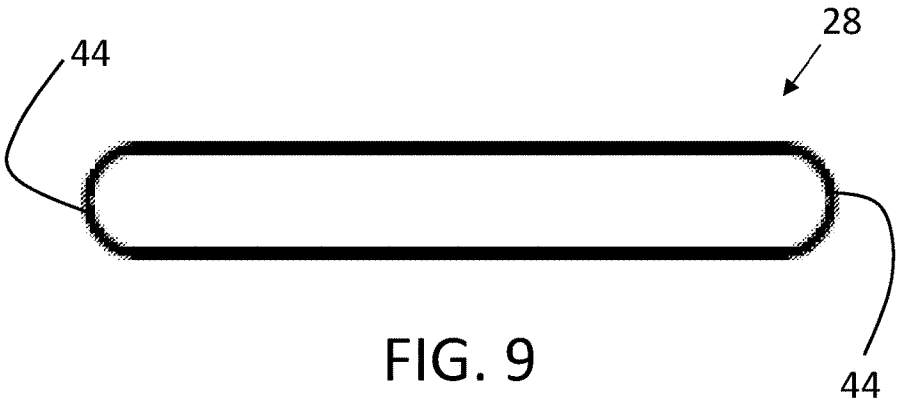
FIG. 9 is a side elevation view of a weight used in association with the weighted wearable training apparatus.
Figure 12:
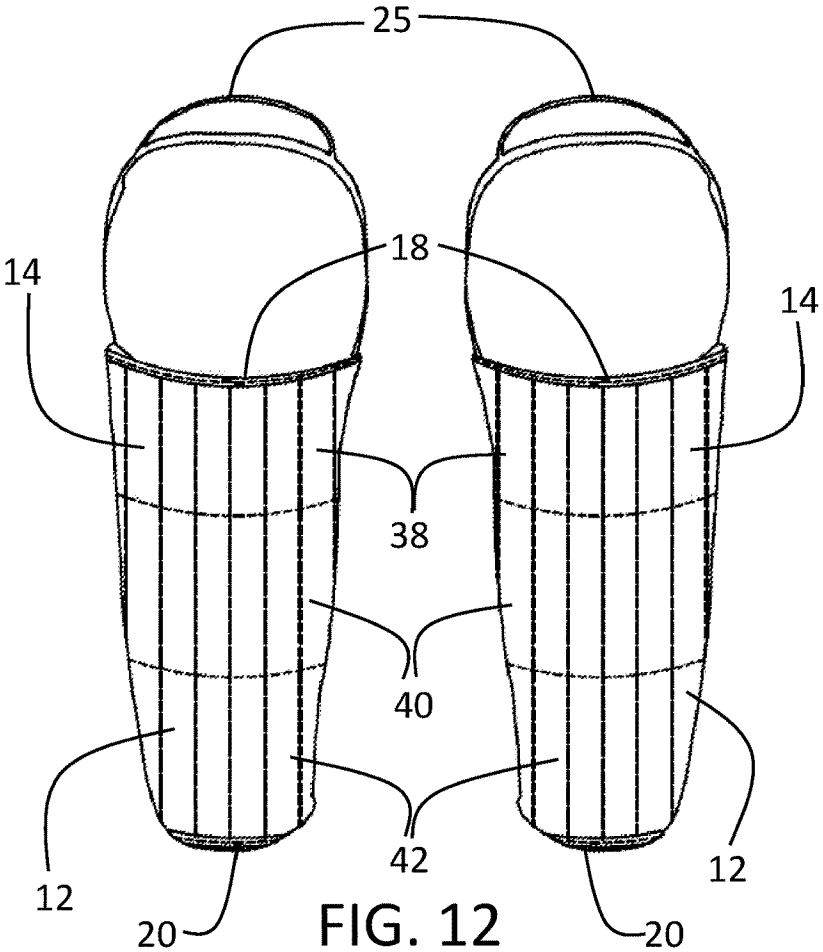
FIG. 12 is a front elevation view of the weighted wearable training apparatus on a hockey shin pad shown in FIG. 10.
Figure 11:
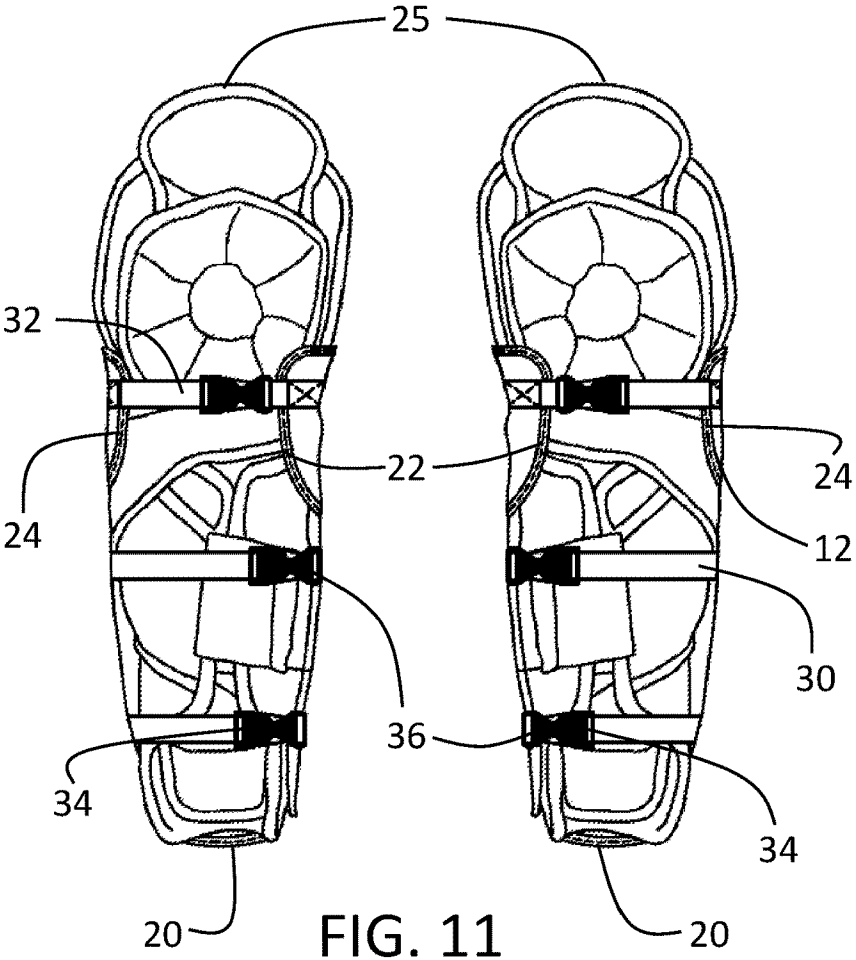
FIG. 11 is a rear elevation view of the weighted wearable training apparatus on a hockey shin pad shown in FIG. 10.

Referring to FIG. 1, a weighted wearable training apparatus 10 has a weight shell 12 with a front surface 14, a rear surface 16, shown in FIG. 2, a top 18, a bottom 20, a first side edge 22 and a second side edge 24. Weight shell 12 is adapted to cover at least a portion of a user's limb. In the embodiment shown, weight shell 12 is adapted to cover a portion of a user's lower leg. Referring to FIG. 10-FIG. 12, weight shell 12 is adapted to fit around a shin pad 25. It will be understood by a person skilled in the art that weight shell 12 may be adapted to cover different portions of a user's limb, including but not limited to the upper leg, the lower arm and the upper arm. Referring to FIG. 2, weight shell 12 has a plurality of pockets 26 on rear surface 16. In the embodiments shown, plurality of pockets 26 are substantially uniform in size. It will be understood by a person skilled in the art that pockets 26 may be different sizes. At least one removable weight 28 is sized to fit within one of pockets 26. In one embodiment, front surface 14 is made of nylon. The nylon may be able to withstand normal wear and tear and extend the life of weighted wearable training apparatus 10. It will be understood by a person skilled in the art that other types of material may be used. In one embodiment, rear surface 16 of weight shell 12 is made of neoprene. Neoprene provides elasticity so weights 28, shown in FIG. 3, are held in pockets 26. Rear surface 16 may be made of a layer of nylon covered by a layer of neoprene. It will be understood by a person skilled in the art that other types of materials may also be used.

Figure 4:
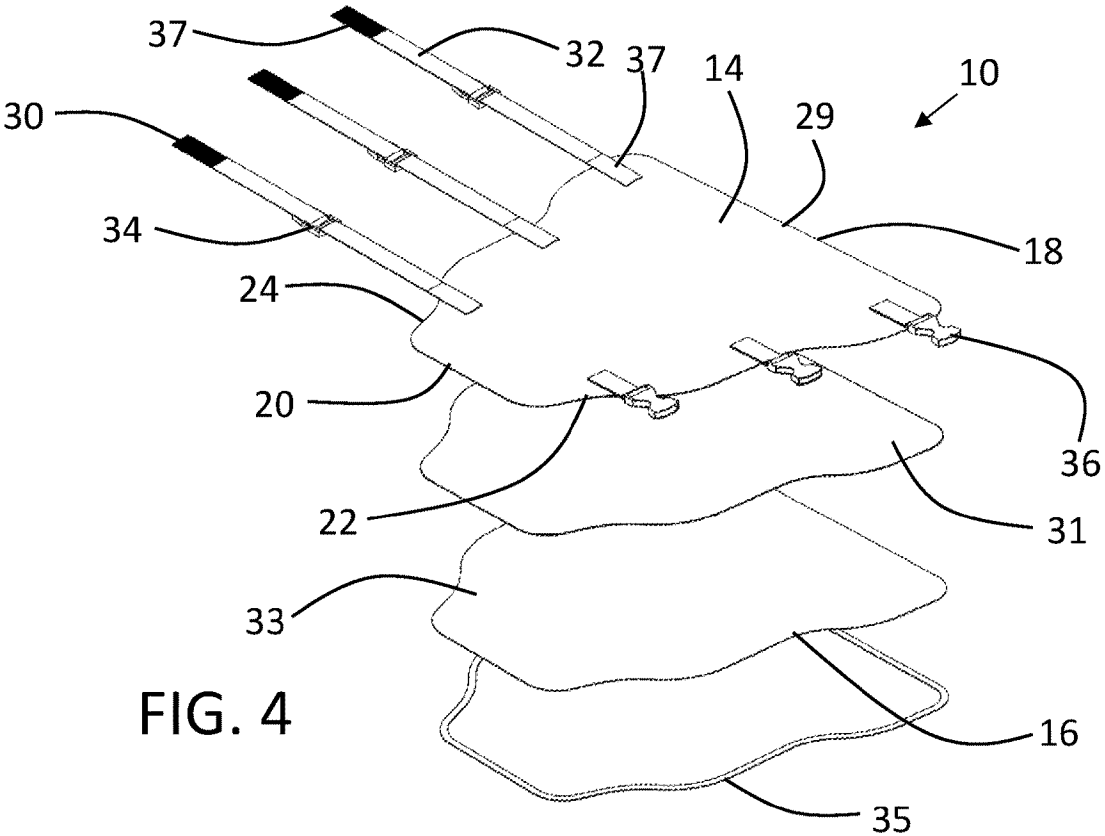
FIG. 4 is an exploded view of the weighted wearable training apparatus shown in FIG. 1.
Figure 7:
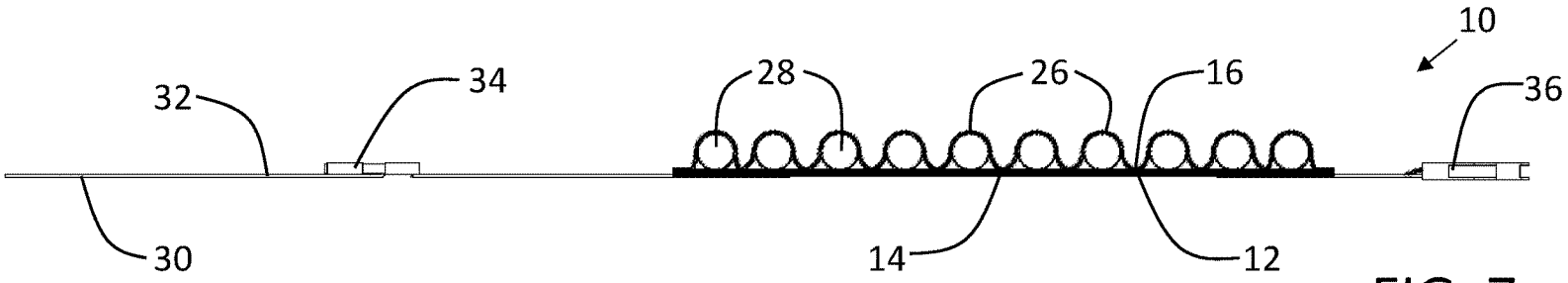
FIG. 7 is a top plan view of the variation of a weighted wearable training apparatus shown in FIG. 5.
Figure 8:
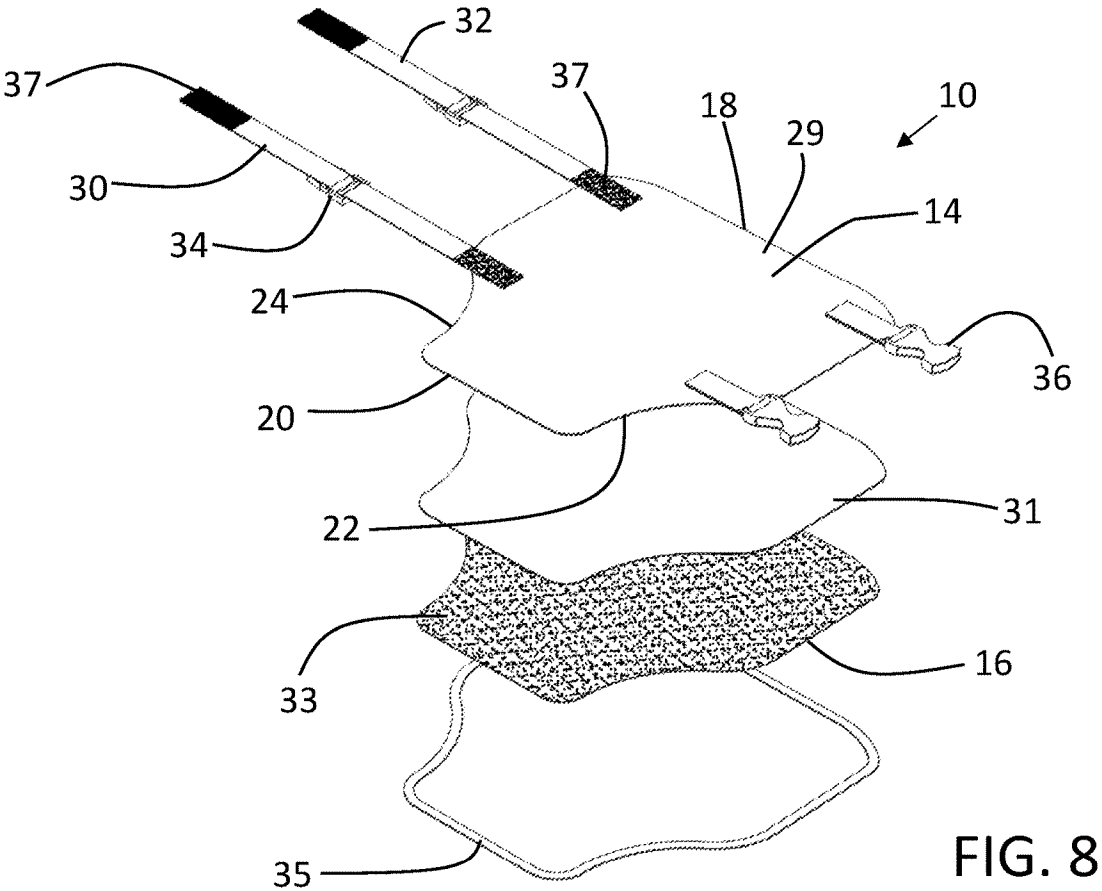
FIG. 8 is an exploded view of the variation of a weighted wearable training apparatus shown in FIG. 5.

Referring to FIG. 4 and FIG. 8, in the embodiment shown, weight shell 12 is made up of a number of layers. A top layer 29 acts as a front surface 14. In one embodiment, top layer 29 is made of nylon. A middle layer 31 may be made of any suitable material such as nylon and provides additional stability to weight shell 12. A bottom layer 33 acts as rear surface 16. In one embodiment, bottom layer 33 is made of neoprene. Neoprene may allow for some stretch, which helps to hold weights 28, shown in FIG. 3 and FIG. 7, in place. A boarder trim 35 may serve to provide additional structural support or be used for decorative purposes.

Attachment mechanisms 30 are provided for holding weight shell 12 to a user's limb. In the embodiment shown, attachment mechanisms 30 include a strap 32 that has a male buckle connector 34, such as the quick release clip shown, that connects to a female buckle connector 36, such as the quick release buckle shown. Male buckle connector 34 can be moved along strap 32 to adjust the length of strap 32. Female buckle connector 36 is attached to front surface 14 of weight shell 12. Male buckle connector 34 and female bucket connector 36 allow for a quick buckling and release. Female buckle connector 36 and male buckle connector 34 may be made of plastic, metal, or any other suitable material known to a person skilled in the art. Strap 32 may have pieces of a hook and loop fastener 37 such as Velcro™ to hold excess strap 32 and prevent it from flapping during movement of the user's limb. Hook and loop fastener 37 may also be used as attachment mechanism 30. It will be understood by a person skilled in the art that different types and positioning of attachment mechanisms 30 may be used. Attachment mechanisms 30 may be positioned to maintain weight shell 12 and weight in a preferred location on user's limb and prevent weight shell 12 from bunching up during use.

Figure 5:
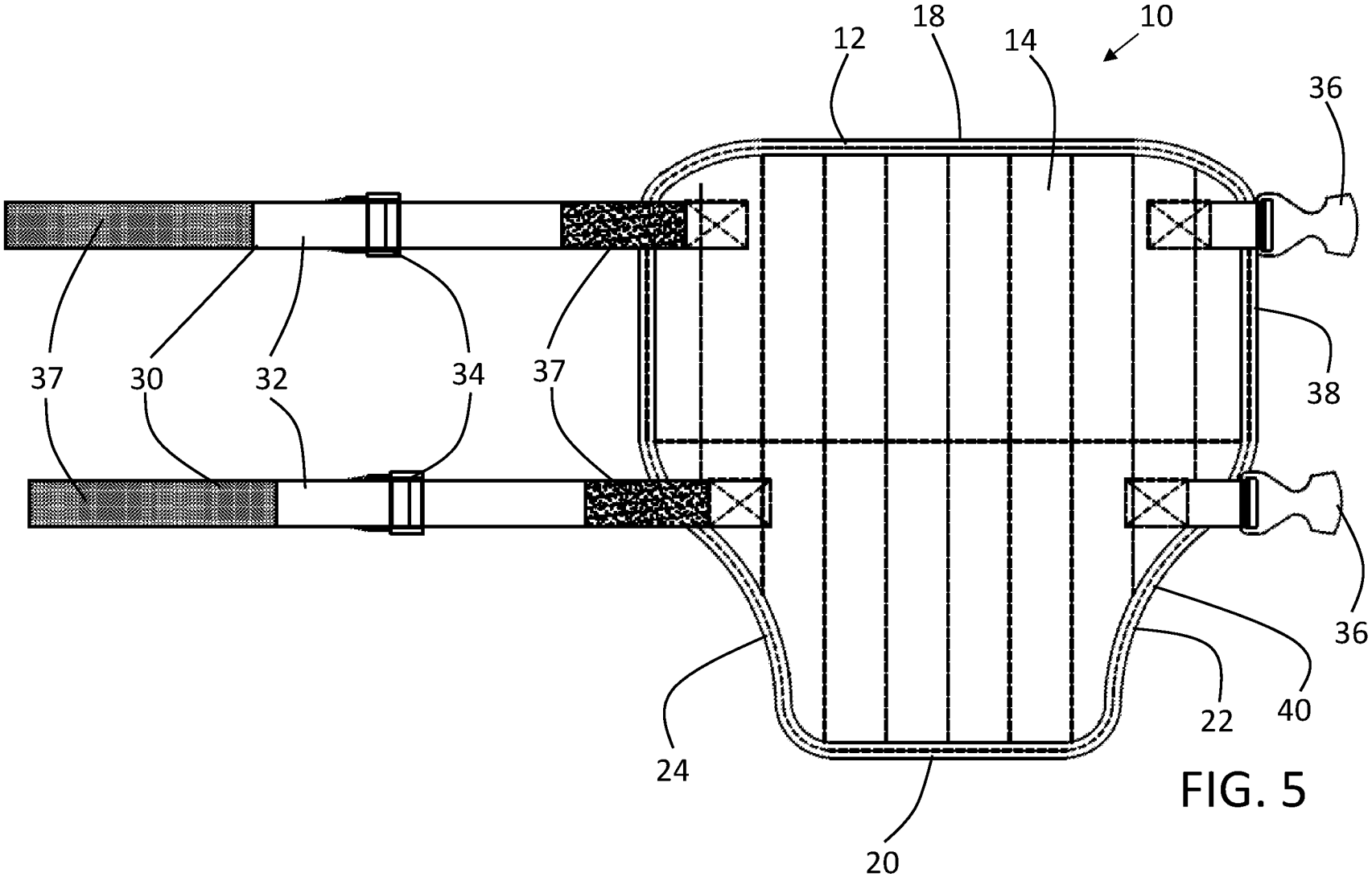
FIG. 5 is a front elevation view of a variation of a weighted wearable training apparatus.
Figure 6:
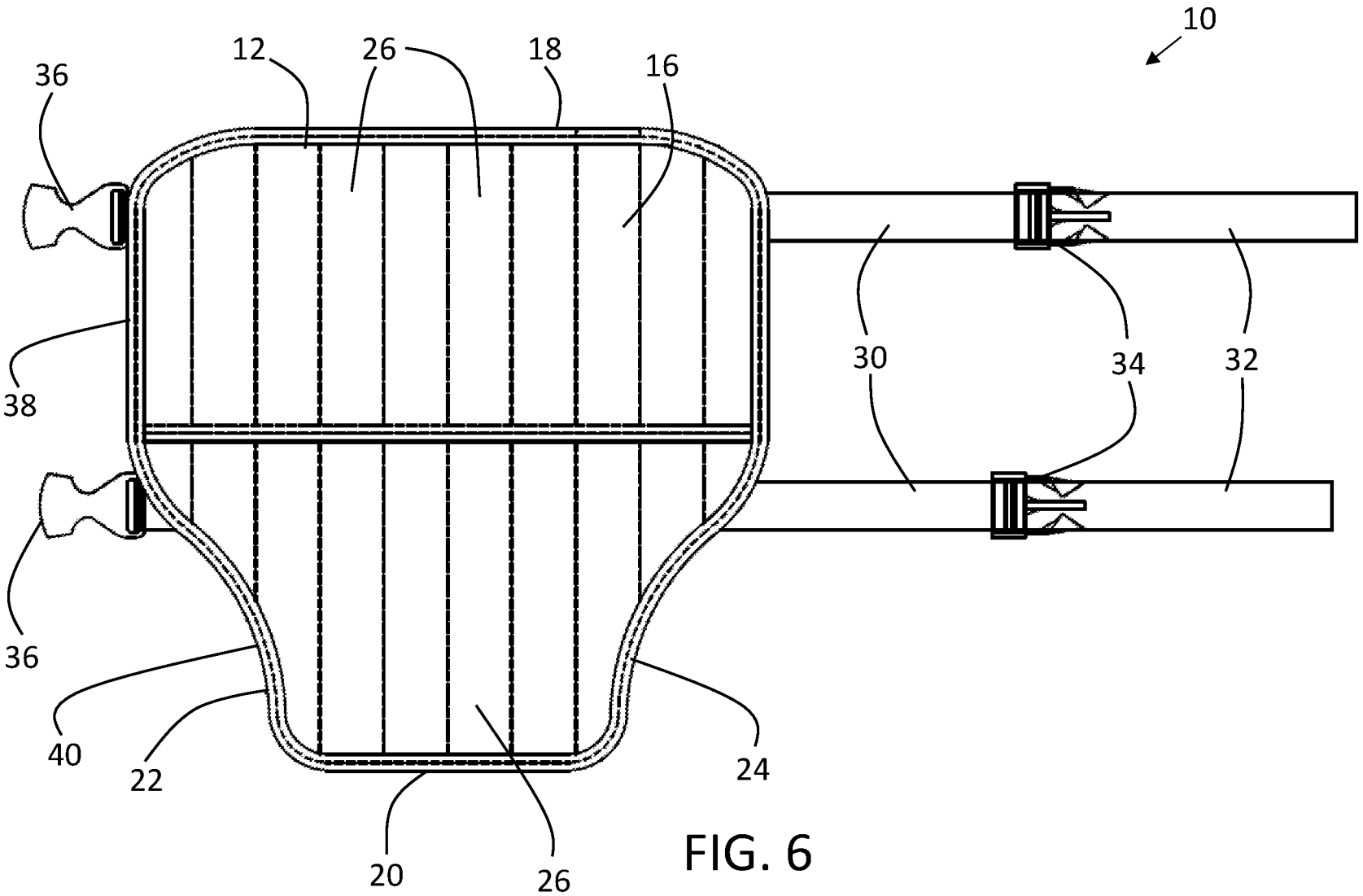
FIG. 6 is a rear elevation view of the variation of a weighted wearable training apparatus shown in FIG. 5.

Referring to FIG. 5, FIG. 6 and FIG. 8, weight shell 12 has a first tier 38 of pockets 26 and a second tier 40 of pockets 26. In the embodiment shown, weight shell 12 is shaped such that second tier 40 has a width less than first tier 38. In the embodiment shown, first tier 38 has ten pockets, eight of which are sized to accommodate a weight 44, shown in FIG. 7, and second tier 40 has six pockets, four of which are sized to accommodate a weight 44. If 0.25 pound weights are used, this allows the minimum added weight to be 0.25 pounds and the maximum added weight to be three pounds. It will be understood by a person skilled in the art that different numbers of pockets may be used.

Referring to FIG. 1, FIG. 2 and FIG. 4, weight shell 12 has a first tier 38 of pockets 26, a second tier 40 of pockets 26 and a third tier 42 of pockets 26. In the embodiment shown, first tier 38 has a width greater than second tier 40 and second tier has a width greater than third tier 38. It will be understood by a person skilled in the art that the number of tiers of pockets 26 may vary depending upon the size of weight shell 12 and the use of weighted wearable training apparatus 10. In the embodiment shown, first tier 38 has sixteen pockets, fourteen of which are sized to accommodate a weight 44, shown in FIG. 3, second tier 40 has twelve pockets, twelve of which are sized to accommodate a weight 44, and third tier 42 has six pockets, six of which are sized to accommodate a weight 44. If 0.25 pound weights are used, this allows the minimum added weight to be 0.25 pounds and the maximum added weight to be eight pounds. It will be understood by a person skilled in the art that different numbers of pockets may be used. For example, referring to FIG. 10-FIG. 12, weight shell 12 with three tiers of pockets 26 may be positioned over a hockey shin pad 25 and is sized for use by an average adult. Referring to FIG. FIG. 5, FIG. 6 and FIG. 8, weight shell 12 with two tiers of pockets 26 may be positioned over a hockey shin pad 25 and is sized for use by a child or small adult. As can be seen, in the embodiments shown, the number of attachment mechanisms 30 for holding weight shell 12 to a user's limb is equal to the number of tiers of pockets 26. The tiers help to distribute weight across the covered portion of the user's limb.

Referring to FIG. 3 and FIG. 7, removable weights 28 are placed in pockets 26. In the embodiment shown in FIG. 9, weights 28 are cylindrical in shape. The cylindrical shape may allow weight shell 12 to conform around the user's limb or shin pad, shown in FIG. 10-FIG. 12. It will be understood by a person skilled in the art that weights 28 may be any other shape, including but not limited to rectangular, square, trapezoid, octagon or half-circle. Weights 28 may have rounded, edged or straight cut edges 44. Preferably, weights 28 are made of stainless steel or other metals that have a high resistance to corrosion. A person of skill will understand that any material may be used to create weights. The weights may be painted, finished or left as raw material. While the dimensions of weights 28 may vary, weights 28 are sized to fit within pockets 26. In one embodiment, weights 28 are four inches long with a diameter of 9/16 of an inch. In another embodiment, weights 28 are four and a half inches long with a diameter of ½ of an inch. It is preferred that each weight 44 weight between 0.25 and 0.5 pounds each. It will be understood by a person skilled in the art that the weight of weight 44 may be greater or lesser than 0.25 to 0.5 pounds. Referring to FIG. 3, a user can choose which pockets 26 to place weight 44 into.

In the embodiment shown in FIG. 1-FIG. 4, a weighted wearable training apparatus 10 for a user's right lower limb is shown. In the embodiment shown in FIG. 5-FIG. 8, a weighted wearable training apparatus 10 for a user's left lower limb is shown. This places female buckle connector 36 on the inside rear of the user's leg. It will be understood by a person skilled in the art that the user may place either weighted wearable training apparatus 10 on either leg based upon user's preference.

Any use herein of any terms describing an interaction between elements is not meant to limit the interaction to direct interaction between the subject elements, and may also include indirect interaction between the elements such as through secondary or intermediary structure unless specifically stated otherwise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent that changes may be made to the illustrative embodiments, while falling within the scope of the invention. As such, the scope of the following claims should not be limited by the preferred embodiments set forth in the examples and drawings described above, but should be given the broadest interpretation consistent with the description as a whole.

What is claimed is:

1. An weighted wearable training apparatus, comprising: a flexible planar weight shell having a front surface, a rear surface, a top, a bottom, a first side edge and a second side edge, the weight shell having a top layer of material, a middle layer of material and a bottom layer of material, the top layer of material being the front surface and the bottom layer of material being the rear surface the middle layer of material providing stability to the weight shell, and the weight shell being adapted to cover at least a portion of a user's limb; a plurality of pockets on the rear surface of the weight shell, the plurality of pockets being positioned in a side by side abutting orientation along an entire length of the rear surface, the weight shell having at least two tiers of pockets, the weight shell being shaped such that each consecutive tier of pockets has a width less than the tier of pockets above and each consecutive tier of pockets has a fewer number of pockets than the tier of pocket above creating a non-cylindrical shape, the weight shell is shaped such that a first tier of pockets is positioned above a second tier of pockets, the first tier of pockets having a width greater than the second tier of pockets; at least one removable weight sized to fit within one of the plurality of pockets to add weight to at least a portion of the user's limb; at least one attachment mechanism for holding the weight shell to the user's limb.

2. The weighted wearable training apparatus of claim 1 wherein attachment mechanism is a strap.

3. The weighted wearable training apparatus of claim 2 wherein a female buckle connector is attached to the weight shell and a male buckle connector is attached to the at least one strap, the male buckle being sized to connect with the female buckle connector.

4. The weighted wearable training apparatus of claim 2 wherein the one strap has a hook and loop fastener to hold excess strap.

5. The weighted wearable training apparatus of claim 1 wherein the weight shell has three tiers of pockets.

6. The weighted wearable training apparatus of claim 5 wherein the weight shell is shaped such that the first tier of pockets is positioned above the second tier of pockets and a third tier of pockets is positioned below the second tier of pockets, the first tier of pockets having a width greater than the second tier of pockets and the second tier of pockets having a width greater than the third tier of pockets.

7. The weighted wearable training apparatus of claim 1 wherein the number of attachment mechanisms for holding the weight shell to the user's limb is equal to the number of tiers of pockets.

8. The weighted wearable training apparatus of claim 1 wherein the at least one attachment mechanism is adjustable.

9. The weighted wearable training apparatus of claim 1 wherein the at least one removable weight is cylindrical in shape.

10. An weighted wearable training apparatus, comprising: a flexible planar weight shell having a front surface, a rear surface, a top, a bottom, a first side edge and a second side edge, and the weight shell being adapted to cover at least a portion of a user's limb, the weight shell is adapted to fit around a shin pad; a plurality of pockets on the rear surface of the weight shell, the plurality of pockets being positioned in a side by side abutting orientation along an entire length of the rear surface, the weight shell having at least two tiers of pockets, the weight shell being shaped such that each consecutive tier of pockets has a width less than the tier of pockets above and each consecutive tier of pockets has a fewer number of pockets than the tier of pocket above creating a non-cylindrical shape, the weight shell is shaped such that a first tier of pockets is positioned above a second tier of pockets, the first tier of pockets having a width greater than the second tier of pockets; at least one removable weight sized to fit within one of the plurality of pockets to add weight to at least a portion of the user's limb; at least one attachment mechanism for holding the weight shell to the user's limb.

11. The weighted wearable training apparatus of claim 1 wherein the front surface of the weight shell is nylon.

12. The weighted wearable training apparatus of claim 1 wherein the rear surface of the weight shell is neoprene.

13. The weighted wearable training apparatus of claim 1 wherein the at least one removable weight is made of stainless steel.

14. The weighted wearable training apparatus of claim 1 wherein the at least one removable weight weighs 0.25 to 6.5 pounds each.

15. The weighted wearable training apparatus of claim 1 wherein the plurality of pockets are uniform in size.

16. The weighted wearable training apparatus of claim 1 wherein the rear surface of the weight shell being covered entirely by the plurality of pockets.

17. An weighted wearable training apparatus, comprising:

a flexible planar weight shell having a front surface, a rear surface, a top, a bottom, a first side edge and a second side edge, the weight shell being adapted to cover at least a portion of a user's limb;

a plurality of pockets on the rear surface of the weight shell, the plurality of pockets being positioned in a side by side abutting orientation along an entire length of the rear surface, the weight shell having at least two tiers of pockets, the weight shell being shaped such that each consecutive tier of pockets has a width less than the tier of pockets above and each consecutive tier of pockets has a fewer number of pockets than the tier of pockets above creating a non-cylindrical shape, the weight shell is shaped such that a first tier of pockets is positioned above a second tier of pockets and a third tier of pockets is positioned below the second tier of pockets, the first tier of pockets having a width greater than the second tier of pockets and the second tier of pockets having a width greater than the third tier of pockets:

at least one removable weight sized to fit within one of the plurality of pockets:

at least one attachment mechanism for holding the weight shell to the user's limb.

* * * * *